United States Patent [19]

Inage et al.

[11] Patent Number: 4,918,489

[45] Date of Patent: Apr. 17, 1990

[54] METHOD OF SUPPLYING RECORDING SHEETS IN IMAGE FORMING APPARATUS

[75] Inventors: Osamu Inage; Takahiro Yagishita, both of Yokohama, Japan

[73] Assignee: Ricoh Co., Ltd., Tokyo, Japan

[21] Appl. No.: 356,130

[22] Filed: May 24, 1989

[51] Int. Cl.[4] ..... G03G 15/00

[52] U.S. Cl. ..... 355/309; 355/311; 355/316; 355/317; 271/3.1; 271/9

[58] Field of Search ..... 355/309, 311, 313, 316, 355/317, 319, 321; 271/3, 9, 3.1, 226, 250, 251, 259

[56] References Cited

U.S. PATENT DOCUMENTS

| | | | |
|---|---|---|---|
| 4,179,117 | 12/1979 | Rhodes, Jr. | 271/251 |
| 4,211,483 | 7/1980 | Hannigan et al. | 355/309 X |
| 4,273,326 | 6/1981 | Snellman et al. | 271/3.1 X |
| 4,569,586 | 2/1986 | Koyama | 355/311 X |
| 4,669,863 | 6/1987 | Yoshiura et al. | 355/311 X |
| 4,693,459 | 9/1987 | Shimoda et al. | 355/311 X |
| 4,706,099 | 11/1987 | Suzuki | 355/311 X |
| 4,763,160 | 8/1988 | Honjo | 271/259 X |
| 4,763,164 | 8/1988 | Ariga et al. | 355/311 |

*Primary Examiner*—A. C. Prescott

*Attorney, Agent, or Firm*—Cooper & Dunham

[57] ABSTRACT

A method of supplying recording sheets from a plurality of paper supplying units to a reference position within a main body of an image forming apparatus which forms an image on each of the sheets supplied successively from the paper supplying units via corresponding transport paths having different lengths comprises the steps of receiving from the units data related to the lengths of the transport paths between the units and the reference position, calculating from the received data a time when a supply of a second sheet is to start from a second unit which is designated relative to a time when a first sheet supplied from a first unit which is designated reaches the reference position when it is assumed that the length of the corresponding transport path from the first paper supplying unit is zero, and driving the first and second units with timings based on the calculated times, so that a recording speed of the image forming apparatus is maintained constant regardless of the length of the transport path used.

12 Claims, 4 Drawing Sheets

METHOD OF SUPPLYING RECORDING SHEETS IN IMAGE FORMING APPARATUS

BACKGROUND OF THE INVENTION

The present invention generally relates to methods of supplying recording sheets, and more particularly to a method of supplying recording sheets of an image forming apparatus.

An image forming apparatus generally refers to various types of copying machines, facsimile machines and printers. Recently, there are image forming apparatuses which use a plurality of paper supplying units for supplying paper, that is, recording sheets on which images are formed. In the image forming apparatus which uses a plurality of paper supplying units, the paper supplying units are often independent and detachable from a main body of the image forming apparatus, and in most cases, a length of a transport path from the paper supplying unit to a reference position in a vicinity of a recording position in the image forming apparatus is different for each paper supplying unit. The length of the transport path will hereinafter be referred to as a transport path length.

But in general, the transport speed of the recording sheets which are transported in the transport paths is constant regardless of the transport paths even when the transport path lengths differ among the paper supplying units and even when the paper supplying speeds of the paper supplying units are different. For this reason, a time it takes for the recording sheet to reach the reference position within the main body of the image forming apparatus from the paper supplying unit becomes different among the transport paths having mutually different transport path lengths and the problems described hereunder occur.

FIGS. 1A and 1B show timings with which the recording sheets are successively supplied from the paper supplying units for explaining the conventional method of supplying the recording sheets. For the sake of convenience, it is assumed that the paper supplying units are independent and detachable from the main body of the image forming apparatus and that the recording sheets supplied from the paper supplying unit have identical sizes.

In FIGS. 1A and 1B, Ai ($i=1, 2, \ldots$) denotes a time when the supplying of a recording sheet #i from the paper supplying unit starts, Bi denotes a time when the supplying of a next recording sheet #i+1 starts when the image formation (recording) is to be made successively on the recording sheets, Ci denotes a time when the recording on the recording sheet which is fed from the time Ai ends, and Di denotes a time when the recording sheet $\pi$i which is fed from the time Ai reaches the reference position within the main body of the image forming apparatus. The transport path length between the paper supplying unit and the reference position within the main body of the image forming apparatus for the case shown in FIG. 1A is shorter than the corresponding transport path length for the case shown in FIG. 1B.

When successively recording images on the recording sheets in FIG. 1A, the first recording sheet #1 is fed from a time A1 and reaches the reference position at the time D1. The first recording sheet #1 is thereafter transported to the recording position and the recording of an image ends at the time C1. When the first recording sheet #1 reaches the reference position at the time D1, the second recording sheet #2 is fed from the time B1 (A2) which is a predetermined time after the time D1. The recording of an image on the second recording sheet #2 is carried out similarly to the first recording sheet #1. The third recording sheet #3 and recording sheets which follow are fed and subjected to the recording in a similar manner.

When successively recording images on the recording sheets in FIG. 1B, the recording sheets are fed and subjected to the recording similarly to FIG. 1A, except that a time interval between the times Ai and Di is longer than that of the case shown in FIG. 1A because the transport path length is longer for the case shown in FIG. 1B.

As may be seen from FIGS. 1A and 1B, the first recording sheet #1 reaches the reference position in the main body of the image forming apparatus at the time D1 in each of the cases shown in FIGS. 1A and 1B, but the time interval between the times A1 and D1 in FIG. 1B is longer than the time interval between the times Al and D1 in FIG. 1A because the transport path length is longer for the case shown in FIG. 1B. On the other hand, a time interval between the times Di and Bi is conventionally set constant regardless of the transport path length. For this reason, the time Ci when the recording ends in FIG. 1B is delayed with respect to the corresponding time Ci in FIG. 1A, and the delay with respect to the case shown in FIG. 1A is accumulated with the number of recording sheets which are subjected to the recording. In other words, the time interval between the times Ai and Di increases as the transport path length increases, but the recording of the image on a previous recording sheet #i-1 progresses during this time interval. As a result, when the timing with which the recording sheets are supplied is controlled by setting the time interval between the times Di and Bi to a constant value regardless of the transport path length, there are problems in that the interval between two successive recording sheets becomes large compared to the transport path length and the above described delay inevitably occurs when the transport path length is large. Therefore, the recording speed of the conventional image forming apparatus becomes slow as the transport path length becomes long.

On the other hand, when the transport path length is short, the interval between two successive recording sheets becomes short compared to the transport path length. In some cases, there is a problem in that a rear end of the leading recording sheet overlaps a front end of the trailing recording sheet of the two successive recording sheets.

SUMMARY OF THE INVENTION

Accordingly, it is a general object of the present invention to provide a novel and useful method of supplying recording sheets in which the problems described above are eliminated.

Another and more specific object of the present invention is to provide a method of supplying recording sheets from a plurality of paper supplying units to a reference position within a main body of an image forming apparatus which forms an image on each of the recording sheets supplied successively from the paper supplying units via corresponding transport paths having different lengths, which method comprises the steps of receiving from the paper supplying units data related to the lengths of the transport paths between the paper supplying units and the reference position within the main body of the image forming apparatus, calculating from the received data a time when a supply of a second recording sheet is to start from a second paper supplying unit which is designated relative to a time when a first recording sheet supplied from a first paper supplying unit which is designated reaches the reference position when it is assumed that the length of the corresponding transport path from the first paper supplying unit is zero, and driving the first and second paper supplying units with timings based on the calculated times, so that a recording speed of the image forming apparatus is maintained constant regardless of the length of the transport path used.

Still another object of the present invention is to provide a method of supplying recording sheets from a plurality of paper supplying units to a reference position within a main body of an image forming apparatus which forms an image on each of the recording sheets supplied successively from the paper supplying units via corresponding transport paths having different lengths, which method comprises the steps of calculating from prestored data a time when a supply of a second recording sheet is to start from a second paper supplying unit which is designated relative to a time when a first recording sheet supplied from a first paper supplying unit which is designated reaches the reference position when it is assumed that the length of the corresponding transport path from the first paper supplying unit is zero, where the prestored data are related to the lengths of the transport paths between the paper supplying units and the reference position within the main body of the image forming apparatus, and driving the first and second paper supplying units with timings based on the calculated times, so that a recording speed of the image forming apparatus is maintained constant regardless of the length of the transport path used.

Other objects and further features of the present invention will be apparent from the following detailed description when read in conjunction with the accompanying drawings.

DESCRIPTION OF THE PREFERRED EMBODIMENTS

Figure 2:
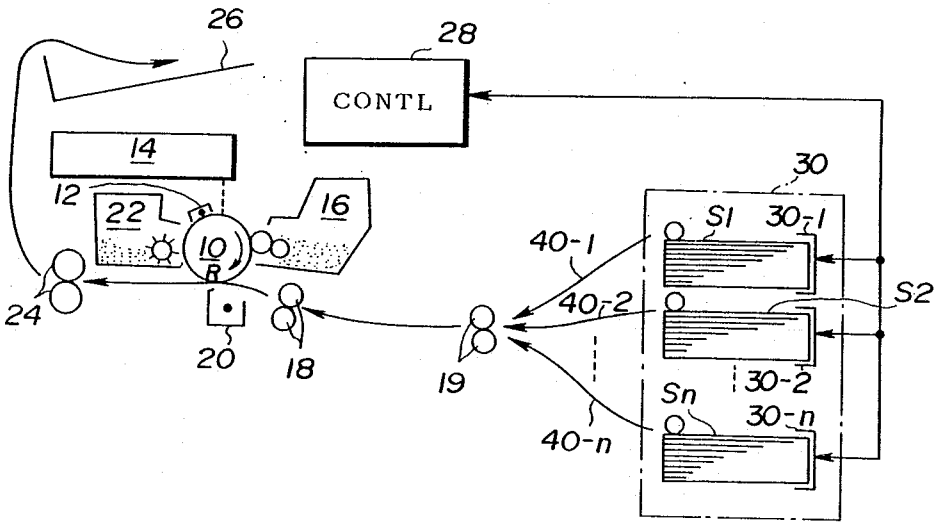
FIG. 2 generally shows an essential part of an image forming apparatus to which an embodiment of a method of supplying recording sheets according to the present invention may be applied.

FIG. 2 generally shows an essential part of an image forming apparatus to which an embodiment of a method of supplying recording sheets according to the present invention may be applied. The image forming apparatus in this embodiment is a laser printer.

In FIG. 2, a photoconductive and photosensitive body 10 has a drum shape and rotates in a direction R at a constant angular velocity at the time of the recording, that is, image formation. When a charger 12 uniformly charges the outer peripheral surface of the photosensitive body 10, a laser write device 14 optically scans the photosensitive body 10 by a laser beam the intensity of which is modulated by an image signal. Hence, a electrostatic image is formed on the outer peripheral surface of the photosensitive body 10. This electrostatic image is developed by a developing unit 16 and visualized into a toner image.

For example, a recording sheet S1 from a paper supplying unit 30-1 is transported in a transport path 40-1 and is transported by reference rollers 19 to a position where a tip end of the recording sheet S1 is pinched between the resist rollers 18. The resist rollers 18 transport the recording sheet S1 to a transfer part of the laser printer in synchronism with a movement of the toner image caused by the rotation of the photosensitive body 10. In the transfer part, a transfer unit 20 transfers the toner image onto the recording sheet S1, and the toner image on the recording sheet S1 is fixed by a fixing unit 24. The recording sheet S1 which is recorded with the image is ejected onto a tray 26 by a known ejection means (not shown). After the toner image is transferred onto the recording sheet S1, the residual toner on the photosensitive body 10 is removed by a cleaning unit 22. The above described recording operation of the laser printer is known.

In this embodiment, the paper supplying unit 30-1 is a part of a paper supplying unit group 30 which is made up of paper supplying units 30-1 through 30-n, and the paper supplying unit group 30 is independent and detachable from a main body of the laser printer. The paper supplying units 30-1 through 30-n are linked to the reference rollers 19 of the main body of the laser printer through corresponding transport paths 40-1 through 40-n. The reference rollers 19 have the function of transporting the recording sheets S1 through Sn to the main body of the laser printer, and a reference position in this embodiment corresponds to the position of the reference rollers 19.

When a power source of the laser printer is turned ON in this embodiment, each of the paper supplying units 30-1 through 30-n supply to a control device 28 data which are related to the time it takes for each of the corresponding recording sheets S1 through Sn to be transported to the reference position through the respective transport paths 40-1 through 40-n. For example, the data supplied to the control device 28 may indicate the lengths of the transport paths 40-1 through 40-n. The control device 28 controls the timings with which the recording sheets S1 through Sn are supplied from the corresponding paper supplying units 30-1 through 30-n responsive to the data received from the paper supplying units 30-1 through 30-n.

Figure 3A:
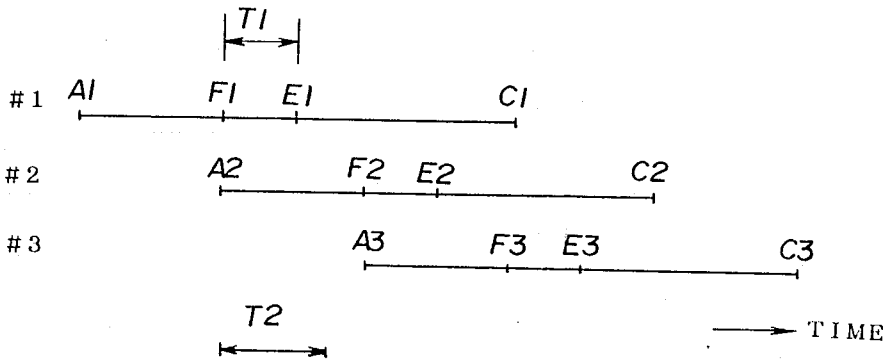
FIGS. 3A and 3B are time charts respectively showing timings with which recording sheets are successively supplied from paper supplying units for explaining the embodiment of a method of supplying recording sheets according to the present invention.
Figure 3B:
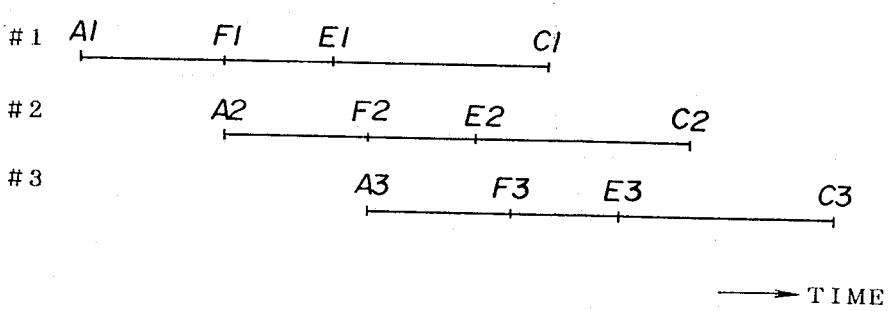

Next, a description will be given of the embodiment of the method of supplying the recording sheets. FIGS. 3A and 3B show timings with which the recording sheets S1 through Sn are successively supplied from the corresponding paper supplying units 30-1 through 30-n for explaining the embodiment of the method of supplying the recording sheets.

In FIGS. 3A and 3B, Ai denotes a time when the supplying of a recording sheet #i from the paper supplying unit starts, Ci denotes a time when the recording on the recording sheet #i which is fed from the time Ai ends, Fi denotes a time when the supplying of a next recording sheet #i+1 starts when the image formation (recording) is to be made successively on the recording sheets, and Ei denotes a time when the supplying of the next recording sheet #i+1 starts when the length of the transport path is regarded as zero. Accordingly, when it is assumed that the length of the recording sheet along the transport direction is constant, a time interval between the times Ei and Ci is constant.

For the sake of convenience, a description is hereunder given by referring to two out of the transport paths 40-1 through 40-n, one having a transport path length LS and the other having a transport path length LL which is longer than LS. FIG. 3A shows the paper supplying timing for the paper supplying unit 30-j which is linked to the transport path 40-j having the transport path length LS. In FIG. 3A, the supplying of the first recording sheet #1 starts at a time Al, and the supplying of the second recording sheet #2 starts at a time F1 (A2). The supplying of the third recording sheet #3 and the subsequent recording sheets is made similarly thereafter.

FIG. 3B shows the paper supplying timing for the paper supplying unit 30-k which is linked to the transport path 40-k having the transport path length LL. In FIG. 3B, the supplying of the first recording sheet #1 starts at a time Al, and the supplying of the second recording sheet #2 starts at a time F1 (A2). The supplying of the third recording sheet #3 and the subsequent recording sheets is made similarly thereafter.

For example, a time it takes for the first recording sheet #1 to reach the reference position in FIG. 3B is longer than a time it takes for the first recording sheet #1 to reach the reference position in FIG. 3A. Thus, the times Ei and Ci in FIG. 3B are delayed compared to the corresponding times Ei and Ci in FIG. 3A.

On the other hand, a time interval between the times Ai and Fi is determined depending on the interval between two successive recording sheets #i and #i+1 which satisfies a condition that the rear end of the recording sheet #i and the tip end of the recording sheet #i+1 do not hit or overlap with each other. Hence, when the length of the recording sheets is constant, the time interval between the times Ai and Ei becomes constant regardless of the transport path length.

This means that a time interval to be changed depending on the transport path length is the time interval between the times Ei and Fi. In other words, the time interval between the times Ei and Fi corresponds to the transport path length which is converted into time, and this time interval is determined by the transport path length and the transport speed at which the recording sheets are transported. But as described above, the transport speed of the recording sheets in the transport path is constant in general.

Therefore, in this embodiment, the control device 28 controls the supply of the recording sheets from the paper supplying units 30-1 through 30-n based on the time data which is related to the time interval determined by the transport path length and the transport speed at which the recording sheets are transported. This means that the recording speed of the laser printer is constant regardless of the length of the transport path used.

In FIG. 3A, the time Fi is set a time T1 before the time Ei. On the other hand, the time Fi is set a time T2 before the time Ei in FIG. 3B, where T2>T1, so that the supply of the recording sheet at the time Ai+1 is started earlier in FIG. 3B when compared with FIG. 3A. Hence, a time difference TD between the time Ei (or Ci) in FIG. 3A and the time Ei (or Ci) in FIG. 3B is constant regardless of the value of i. But if the time Fi were set a constant time T (for example, T=T1) before the time Ei for both cases shown in FIGS. 3A and 3B, a time different TDD between the times Ei (or Ci) in FIG. 3A and the time Ei (or Ci) in FIG. 3B becomes larger than the time difference TD described above, and the difference as a whole considerably increases as the number of recording sheets increases.

Figures 1A, 1B:
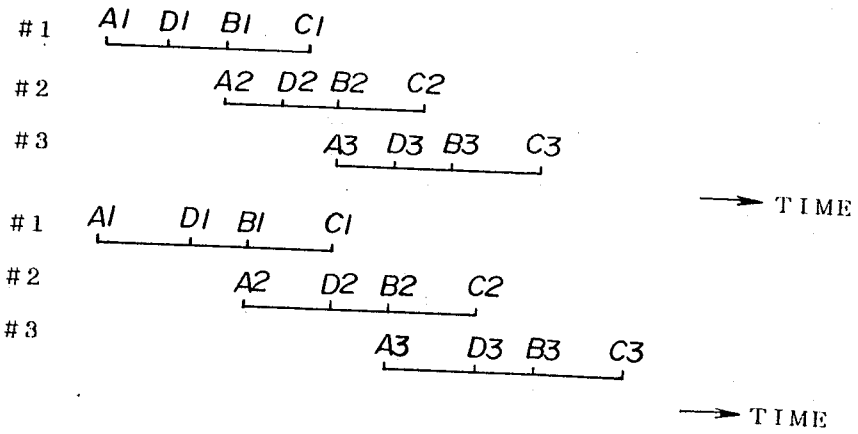
FIG. 1A PRIOR ART
FIG. 1B PRIOR ART
FIGS. 1A and 1B are time charts respectively showing timings with which recording sheets are successively supplied from paper supplying units for explaining a conventional method of supplying the recording sheets.

The problems generated conventionally are primarily caused by the fact that the time interval between the times Di and Bi in FIGS. 1A and 1B is set to a constant value regardless of the transport path length, but the present invention overcomes the problems because the time interval between the times Fi and Ei is variable depending on the transport path length.

Figure 4:
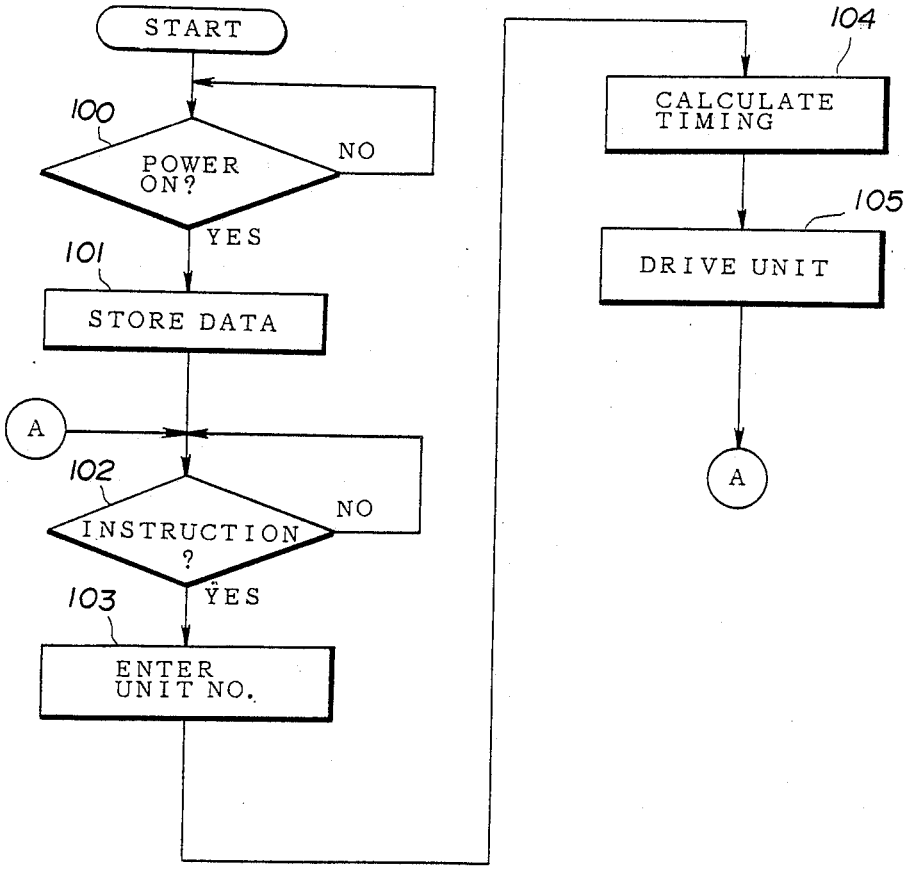
FIG. 4 is a flow chart for explaining an embodiment of an operation of a control device shown in FIG. 2.

Next, a description will be given of an embodiment of an operation of the control device 28 shown in FIG. 2 when realizing the embodiment of the method described heretofore, by referring to FIG. 4. In FIG. 4, a step 100 discriminates whether or not the power source of the laser printer is turned ON. When the discrimination result in the step 100 becomes YES, step 101 stores the data received from the paper supplying unit group 30. The data includes data related to the lengths of the transport paths 40-1 through 40-n which are respectively linked to the paper supplying units 30-1 through 30-n of the paper supplying unit group 30. Then, a step 102 discriminates whether or not a recording instruction is received. This recording instruction is received from a control panel (not shown) of the laser printer or is generated internally in the control device 28 in response to an instruction entered form the control panel, and instructs the operating sequence of the paper supplying units 30-1 through 30-n.

When the discrimination result in the step 102 becomes YES, a step 103 enters a unit number of the paper supplying unit designated by the received instruction, and a step 104 calculates the paper supplying timing for the second and subsequent recording sheets based on the data stored in the step 101. After the step 104, a step 105 drives the designated paper supplying unit with the calculated timing, and the process returns to the step 102.

In the case where the paper supplying units 30-1 through 30-n are an integral part of the laser printer and fixed, the transport path lengths are fixed and it is possible to obtain the calculated results in advance for each data (transport path length) and prestore the calculated results in the form of a look-up table and look up the table depending on the received instruction. In this case, the steps 100, 101 and 102 may be omitted.

Moreover, the embodiment described heretofore are explained with reference to the case where the recording sheets are successively supplied from one paper supplying unit, but the effects of the present invention can also be obtained similarly when the recording sheets are successively supplied from different paper supplying units because the recording speed is maintained constant regardless of the transport path length.

Further, the present invention is not limited to these embodiments, but various variations and modifications may be made without departing from the scope of the present invention.

What is claimed is:

1. A method of supplying recording sheets from a plurality of paper supplying units to a reference position within a main body of an image forming apparatus which forms an image on each of the recording sheets supplied successively from the paper supplying units via corresponding transport paths having different lengths, said method comprising the steps of:

receiving from the paper supplying units data related to the lengths of the transport paths between the paper supplying units and the reference position within the main body of the image forming apparatus;

calculating from the received data a time when a supply of a second recording sheet is to start from a second paper supplying unit which is designated relative to a time when a first recording sheet supplied from a first paper supplying unit which is designated reaches the reference position when it is assumed that the length of the corresponding transport path from the first paper supplying unit is zero; and driving the first and second paper supplying units with timings based on the calculated times, so that a recording speed of the image forming apparatus is maintained constant regardless of the length of the transport path used.

2. The method of supplying recording sheets as claimed in claim 1 wherein said first and second paper supplying units are mutually different paper supplying units and the transport path between the first paper supplying unit and the reference position and the transport path between the second paper supplying unit and the reference position have mutually different lengths.

3. The method of supplying recording sheets as claimed in claim 1 wherein said first and second paper supplying units are the same paper supplying unit.

4. The method of supplying recording sheets as claimed in claim 1 wherein a first time interval between the calculated time when the supply of the first recording sheet is to start from the first paper supplying unit and a time when a recording on the first recording sheet ends is fixed, and a second time interval between the calculated time when the supply of the second recording sheet is to start from the second paper supplying unit and a time when a recording on the second recording sheet ends is fixed, said first and second time intervals being identical to each other.

5. The method of supplying recording sheets as claimed in claim 1 wherein said step of receiving data receives the data from the paper supplying units when a power source of the image forming apparatus is turns ON.

6. The method of supplying recording sheets as claimed in claim 1 wherein said step of receiving data includes a substep of storing the data received from the paper supplying units, and said step of calculating calculates the times by referring to the stored data.

7. The method of supplying recording sheets as claimed in claim 1 wherein the paper supplying units are independent and detachable from the main body of the image forming apparatus.

8. A method of supplying recording sheets from a plurality of paper supplying units to a reference position within a main body of an image forming apparatus which forms an image on each of the recording sheets supplied successively from the paper supplying units via corresponding transport paths having different lengths, said method comprising the steps of:

calculating from prestored data a time when a supply of a second recording sheet is to start from a second paper supplying unit which is designated relative to a time when a first recording sheet supplied from a first paper supplying unit which is designated reaches the reference position when it is assumed that the length of the corresponding transport path from the first paper supplying unit is zero, said prestored data being related to the lengths of the transport paths between the paper supplying units and the reference position within the main body of the image forming apparatus; and driving the first and second paper supplying units with timings based on the calculated times, so that a recording speed of the image forming apparatus is maintained constant regardless of the length of the transport path used.

9. The method of supplying recording sheets as claimed in claim 8 wherein said first and second paper supplying units are mutually different paper supplying units and the transport path between the first paper supplying unit and the reference position and the transport path between the second paper supplying unit and the reference position have mutually different lengths.

10. The method of supplying recording sheets as claimed in claim 8 wherein said first and second paper supplying units are the same paper supplying unit.

11. The method of supplying recording sheets as claimed in claim 8 wherein a first time interval between the calculated time when the supply of the first recording sheet is to start from the first paper supplying unit and a time when a recording on the first recording sheet ends is fixed, and a second time interval between the calculated time when the supply of the second recording sheet is to start from the second paper supplying unit and a time when a recording on the second recording sheet ends is fixed, said first and second time intervals being identical to each other.

12. The method of supplying recording sheets as claimed in claim 8 wherein the paper supplying units are an integral part of the main body of the image forming apparatus.

* * * * *